US005330705A

United States Patent [19]

Culling

[11] Patent Number: 5,330,705

[45] Date of Patent: Jul. 19, 1994

[54] HEAT RESISTANT ALLOYS

[75] Inventor: John H. Culling, St. Louis, Mo.

[73] Assignee: Carondelet Foundry Company, Pevely, Mo.

[21] Appl. No.: 72,150

[22] Filed: Jun. 4, 1993

[51] Int. Cl.[5] ..... C22C 38/42; C22C 19/05; C22C 30/00

[52] U.S. Cl. ..... 420/49; 420/582

[58] Field of Search ..... 420/49, 582, 444, 446, 420/447

[56] References Cited

U.S. PATENT DOCUMENTS

| | | | |
|---|---|---|---|
| 2,553,330 | 5/1951 | Post et al. | 75/122 |
| 4,063,934 | 12/1977 | Thuillier et al. | 75/122 |
| 4,077,801 | 3/1978 | Heyer et al. | 75/122 |
| 5,077,006 | 12/1991 | Culling | 420/584.1 |

FOREIGN PATENT DOCUMENTS

| | | | |
|---|---|---|---|
| 47-31205 | 8/1972 | Japan | 420/49 |
| 59-38365 | 3/1984 | Japan | 420/49 |
| 1534926 | 12/1978 | United Kingdom . | |

*Primary Examiner*—Deborah Yee

*Attorney, Agent, or Firm*—Senniger, Powers, Leavitt & Roedel

[57] ABSTRACT

Air-meltable, air-castable, weldable, heat resistant alloys that exhibit high creep rupture strengths and high ductilities. An H-type base alloy or a high silicon base alloy contains additions of about 0.6% to 2.5% copper and 0.55% to 2.65% microalloying amounts of the group 0.2% to 0.85% tungsten, 0.2% to 0.85% molybdenum, 0.1% to 0.5% columbium and 0.05% to 0.45% titanium.

10 Claims, No Drawings

HEAT RESISTANT ALLOYS

BACKGROUND OF THE INVENTION

Many industrial operations employ cast heat resistant alloy shapes welded to other cast or wrought shapes. Additionally, it is often desirable to be able to perform repair welding on heat resistant castings either before or after some period of service. It has been found by those working in the art that heat resistant castings of less than about 8% tensile elongation present substantial welding difficulties, and those of less than about 5% present extreme welding difficulties.

While the several grades of standard heat resistant alloys (H-type) of the STEEL FOUNDERS SOCIETY OF AMERICA—ALLOY CASTINGS INSTITUTE (SFSA-ACI) have been altered to improve hot strength by fairly large additions of certain elements, Heyer, et al, U.S. Pat. No. 4,077,801, appears to have been the first disclosure of improving hot strength and rupture life of such alloys by additions to the base alloys of less than one percent each of two or more elements selected from molybdenum, tungsten, columbium, zirconium, nitrogen, titanium, cesium, lanthanum and boron. Use of such small additions is sometimes referred to as microalloying. It has been reported that microalloying in accordance with the '801 patent tends to reduce room temperature elongations about 25% to 50% below those for the untreated base alloy. While alloy types HF and HP have not been found to have presented much difficulty in microalloyed production heats, alloy types HH, HK and HT have often had such low ductilities as to present severe welding problems. Alloy type HH is probably the most widely employed of the H-type alloys, while alloy type HK is most likely second in volume of use.

It is also known that there is a close correlation between hot strength and the sum of carbon plus nitrogen content for any H-type base alloy. Thus, while there have been variations, depending upon base alloy type and other factors, about a 50% increase in hot strength is regularly attained in most H-type alloys at any given carbon plus nitrogen level by microalloying with elements from the group molybdenum, tungsten, columbium, titanium and zirconium. For, example, Post, et al., U.S. Pat. No. 2,553,330, discloses improvements in the hot workability of virtually all corrosion and heat resistant alloys by small additions of rare earth elements.

Culling, U.S. Pat. No. 5,077,006, sought to overcome the poor weldability and tendency to hot tear during casting associated with the microalloying approach disclosed in the '801 patent by microalloying with the six components, molybdenum, tungsten, columbium, titanium, zirconium and rare earth elements. While there was some improvement in properties over the '801 patent, room temperature elongations of H-type base alloys still declined with microalloying according to the '006 patent at any given carbon plus nitrogen level.

The amounts of zirconium and rare earth elements in alloys produced according to the '006 patent by ordinary air melting and pouring practices have been difficult to control. Thus, rare earth and zirconium oxide discontinuities have been observed in the microstructure of low elongation production heats.

While copper has been included in the formulation of hundreds of corrosion-resistant alloys, it has generally been considered to be detrimental or at least not beneficial to hot strength and rupture life in heat-resistant alloys. Copper is frequently found in heat-resistant alloys as a tramp, residual or unintentional element in amounts of about 0.1% to 0.4%, but is customarily either ignored or specified as a maximum of 0.5% by weight. An exception to the usual position that copper is undesirable in heat resistant alloys is disclosed by Thuillier et al., U.S. Pat. No. 4,063,934, which claims a heat-resistant alloy based on nickel and chromium, and possibly on iron, offering high oxidation, carburization and/or creep resistance at very high temperatures. In the '934 patent it is said that a nickel/chromium ratio between 1.20 and 1.40 is the main factor in the striking improvement in the carburization resistance of the alloys of that invention, but that further improvements can be achieved by further additions of the following elements whose preferred ranges are:

| | |
|---|---|
| Cu | 0.5 to 5% |
| C | 0.4 to 0.6% |
| Nb (Cb) | 1 to 2% |
| (W + Mo) | 1 to 5% |

The exemplary alloys for which test data on carburization resistance is provided contain about 1% niobium plus about 1.5% of either tungsten or molybdenum, 0.4% to 0.6% carbon, and optionally 1.6% or 1.7% copper. The test data indicate good carburization resistance with further improvements provided by the addition of copper. The '934 patent also states that the disclosed alloys have high creep resistance up to very high temperatures, but no test data were provided.

In addition, although austenitic high silicon iron-nickel-chromium base alloys produced by the microalloying procedures disclosed in U.S. patent application Ser. No. 911,145, filed Jul. 9, 1992, have not presented room temperature elongation problems, improvement in their hot strength and corrosion resistance properties is desirable.

SUMMARY OF THE INVENTION

It is therefore an object of this invention to provide improved heat resistant alloys of (1) the ACI-type or similar types and (2) the austenitic high-silicon type that have relatively high hot strength and long life in structural parts of industrial furnaces and in similar installations in which such parts must also have good room temperature elongation and weldability as well as excellent resistance to hot gas corrosion and/or carburization at service temperature as high as 2000° to 2200° F. A further object is to provide such alloys that can be readily produced by ordinary air melting and casting techniques and equipment without metallurgical detriment.

Thus, the present invention provides outstanding improvement in hot strength and rupture life of H-type alloys without the serious degradation of room temperature elongation and weldability frequently encountered in prior art alloys. The invention also provides excellent hot strength improvement in austenitic high-silicon iron-nickel-chromium base alloys, with or without aluminum, and improved high temperature corrosion resistance.

Briefly, therefore, the present invention is directed to air-meltable, air-castable, weldable, heat resistant alloys that exhibit high creep rupture strengths and high ductilities. These alloys consist of one of two base alloys containing additions of copper and microalloying amounts of the group tungsten, molybdenum, columbium and titanium. More particularly, the alloys of the invention comprise a base alloy, about 0.6% to about 2.5% copper and 0.55% to 2.65% of a microalloying group of elements, said base alloy being selected from the group consisting of H-type alloys and high silicon alloys, said alloys having the following compositions by weight:

| | Base Alloy | |
|---|---|---|
| | H-Type | High Silicon |
| Nickel | 8% to 62% | 10.5 to 28% |
| Chromium | 12% to 32% | 14.8 to 23% |
| Silicon | up to 2.5% | 3% to 6.6% |
| Manganese | up to 3% | 0.2% to 4% |
| Aluminum | less than 0.5% | up to 4% |
| Carbon | 0.12 to 0.6% | 0.12% to 0.5% |
| Cobalt | up to 1.5% | up to 1.5% |
| Iron | Essentially balance | Essentially balance |

and said microalloying group of elements consisting essentially of, by weight:

| | |
|---|---|
| Tungsten | 0.2% to 0.85% |
| Molybdenum | 0.2% to 0.85% |
| Columbium | 0.1% to 0.5% |
| Titanium | 0.05 to 0.45% |

DETAILED DESCRIPTION OF THE INVENTION

The present invention is directed to providing improved austenitic, high not strength, heat resistant alloys having good room temperature elongation and weldability and excellent resistance to hot gas corrosion and/or carburization by the addition, by weight, of about 0.6% to about 2.5% copper, preferably about 0.65% to about 2.0%, and from about 0.55% to about 2.65% of the microalloying group of elements disclosed above, preferably about 1% to about 1.5%.

In particular, the present invention, in the case of the modified H-type alloys of the '006 patent and similar alloys, is directed to achieving the high hot strengths of those alloys by eliminating additions of zirconium and rare earth elements and altering the microalloying additions taught therein to within the ranges disclosed above, plus the addition, by weight, of copper in amounts of about 0.6% to about 2.5%, preferably about 0.75% to about 1.8%. In the case of the high silicon alloys, the invention is directed to improving the hot strength of those alloys while maintaining their relatively good room temperature elongations by the addition, by weight, of the copper and microalloying group in the amounts disclosed above. For the high silicon alloys it is preferred to employ copper in the range of about 0.65% to about 1.1%, by weight. Thus, it was found that by microalloying the H-type alloys and the high silicon alloys according to the present invention that hot strength can be improved without loss of room temperature ductility.

The essential components of the alloys of the invention consist of, by weight, certain base alloys, from about 0.6% to about 2.5% copper and about 0.55% to about 2.65% of a microalloying group of elements consisting essentially of:

| | |
|---|---|
| Tungsten | 0.2% to 0.85% |

-continued

| | |
|---|---|
| Molybdenum | 0.2% to 0.85% |
| Columbium | 0.1% to 0.5% |
| Titanium | 0.05% to 0.45% |

The base alloys are, by weight, as follows:

| | H-TYPE | High Silicon |
|---|---|---|
| NICKEL: | 8% to 62% | 10.5% to 28% |
| CHROMIUM: | 12% to 32% | 14.8% to 23% |
| SILICON: | up to 2.5% | 3% to 6.6% |
| MANGANESE: | up to 3% | 0.2% to 4% |
| ALUMINUM: | less than 0.5% | up to 4% |
| CARBON: | 0.12% to 0.6% | 0.12% to 0.5% |
| COBALT: | up to 1.5% | up to 1.5% |
| IRON: | Essentially balance | Essentially balance |

Accordingly, the alloys of the invention, denominated A and B, consisting of a base alloy, copper and a microalloying group of elements, have the following compositions by weight:

| | Alloys | |
|---|---|---|
| | A | B |
| Copper | 0.6 to 2.5% | 0.6 to 2.5% |
| Nickel | 8% to 62% | 10.5 to 28% |
| Chromium | 12% to 32% | 14.8% to 23% |
| Silicon | up to 2.5% | 3% to 6.6% |
| Manganese | up to 3% | 0.2% to 4% |
| Aluminum | less than 0.5% | up to 4% |
| Carbon | 0.12% to 0.6% | 0.12% to 0.55 |
| Cobalt | up to 1.5% | up to 1.5% |
| Microalloying Group | 0.55% to 2.65% | 0.55% to 2.65% |
| Iron | Essentially balance | Essentially balance |

said microalloying group consisting essentially of, by weight:

| | |
|---|---|
| Tungsten | 0.2% to 0.85% |
| Molybdenum | 0.2% to 0.85% |
| Columbium | 0.1% to 0.5% |
| Titanium | 0.05% to 0.45% |

The addition of copper and small amounts of the microalloying group of elements increases hot strength of the base alloys mainly by their effects upon size, shape, distribution and characteristics of the carbides that are formed in these alloys. Therefore, while there are measurable increases in hot strength, as compared to untreated alloys, even at very low carbon contents, the alloys of the invention contain a minimum of about 0.12% carbon to provide adequate structural hot strength for most high temperature application. Also, while the improvements in hot strength achieved over the hot strength of untreated alloys is very large in alloys containing 0.7% carbon or even 0.75% carbon, for good weldability and high room temperature tensile elongation the high silicon alloys of the invention contain a maximum of about 0.5% carbon, and the H-type alloys of the invention contain a maximum of about 0.6% carbon.

An alloy of the present invention has hot strength approximately equal to the untreated same base alloy of about 0.1% higher carbon content. For example, an HK-type alloy of about 0.3% carbon treated in accordance with the invention has about the same hot strength and rupture life of an untreated HK-type base alloy of 0.4% carbon. Alloys of the invention always have higher tensile elongations than base alloys of the same type at carbon levels that result in equal hot strengths. The instant alloys also have higher room temperature elongations than the same alloy types at the same carbon levels prepared in accordance with the '006 patent. In addition, alloys of the invention have carburization resistance superior to either the base alloys or those of '006 patent primarily due to the copper content.

EXAMPLE 1

One hundred pound heats of several different alloys were prepared in accordance with the invention and cast in standard ASTM test bar keel blocks. The composition of these alloys is set forth in Table II. The number in the designation of each of the inventive alloys is the carbon content of the alloy times one hundred. Each SFSA-ACI type alloy of the invention is identified by the same letters that are employed as standard designations for the base types from which they were derived except that each is also followed by the symbol for copper (Cu). Heats were similarly prepared and cast into keel blocks for the six exemplary alloys of U.S. Pat. No. 4,063,934 and for modified versions of those alloys. These alloys are identified in Table I with an I plus a subscript number and as the same followed by "MOD." Heats were made up to the same composition as all six of the exemplary alloys of the '934 patent, tensile tested at room temperature, and tested for creep rupture life at various elevated temperatures. As is shown below in Table II, heats made up to match alloys $I_1$, $I_2$, $I_3$, $I_4$ and $I_5$ of the '934 patent had low elongation values, while all six heats showed poor rupture lives compared to similar alloys of the present invention and to those microalloyed according to U.S. Pat. No. 5,077,006.

TABLE II

| | COMPOSITION BY WEIGHT PERCENT[1] | | | | | | | | | |
|---|---|---|---|---|---|---|---|---|---|---|
| ALLOY DESIGNATION | Ni | Cr | Si | Mn | C | Cu | W | Mo | Cb | Ti |
| Si19Cu | 19.86 | 20.11 | 4.55 | 1.23 | .19 | .76 | .41 | .43 | .26 | .12 |
| Si21Cu | 22.02 | 17.82 | 3.76 | .66 | .21 | 1.03 | .57 | .27 | .35 | .13 |
| Si25Cu | 11.66 | 15.89 | 4.61 | 2.31 | .25 | 1.10 | .21 | .28 | .31 | .22 |
| SiA123Cu[2] | 16.55 | 18.39 | 3.53 | 1.50 | .23 | .68 | .25 | .75 | .23 | .11 |
| Si31Cu | 16.67 | 16.25 | 6.26 | 2.27 | .31 | .88 | .51 | .32 | .22 | .23 |
| HH30Cu | 13.26 | 25.05 | .58 | 1.14 | .30 | .86 | .43 | .45 | .21 | .11 |
| HH32Cu | 14.15 | 24.17 | .76 | .88 | .32 | 1.03 | .31 | .29 | .32 | .13 |
| HH38Cu | 12.96 | 24.83 | .98 | .76 | .38 | .96 | .38 | .42 | .28 | .10 |
| HH41Cu | 12.81 | 25.11 | 1.02 | .66 | .41 | .84 | .51 | .39 | .26 | .17 |
| HK31Cu | 22.03 | 24.86 | .59 | .73 | .31 | 1.08 | .52 | .48 | .29 | .20 |
| HK33Cu | 21.20 | 25.57 | .66 | .58 | .33 | 1.15 | .58 | .43 | .25 | .17 |
| HK36Cu | 20.87 | 24.96 | .45 | .66 | .36 | .88 | .35 | .56 | .32 | .21 |
| HK46Cu | 23.05 | 24.21 | .95 | 1.51 | .46 | 1.02 | .47 | .34 | .21 | .11 |
| HK51Cu | 21.12 | 25.08 | .86 | .85 | .51 | 1.57 | .42 | .65 | .26 | .13 |
| HN30Cu | 25.11 | 21.45 | .84 | .47 | .30 | .93 | .39 | .19 | .28 | .19 |
| HP25Cu | 37.07 | 23.16 | .58 | .63 | .25 | 1.79 | .42 | .30 | .21 | .12 |
| HP39Cu | 36.21 | 23.55 | .57 | .66 | .39 | .88 | .42 | .53 | .23 | .18 |
| HP42Cu | 37.03 | 25.19 | .63 | .81 | .42 | 1.16 | .39 | .45 | .21 | .13 |
| HP46Cu | 35.11 | 26.02 | .78 | .65 | .46 | 1.28 | .45 | .35 | .28 | .11 |
| HT34Cu | 36.53 | 17.24 | .79 | .90 | .34 | .87 | .49 | .24 | .23 | .24 |
| $I_1$ | 32.02 | 25.11 | 1.46 | .71 | .41 | — | — | 1.62 | 1.03 | — |
| $I_2$ | 43.96 | 35.02 | 1.68 | .78 | .60 | — | 1.43 | — | 1.19 | — |
| $I_3$ | 32.44 | 26.96 | 1.58 | .62 | .59 | 1.61 | 1.38 | — | 1.11 | — |
| $I_4$ | 44.58 | 34.04 | 1.33 | .78 | .61 | 1.73 | 1.58 | — | 1.09 | — |
| $I_5$ | 50.81 | 37.07 | 1.25 | .71 | .21 | 4.44 | .22 | .23 | 1.28 | — |
| $I_6$ | 29.05 | 22.12 | 1.88 | 1.25 | .02 | .61 | 1.53 | 2.98 | 2.06 | — |
| $I_1$ MOD | 32.66 | 24.98 | .86 | .66 | .42 | — | .53 | .45 | .31 | .12 |
| $I_2$ MOD | 45.02 | 34.88 | .72 | .59 | .55 | — | .56 | .38 | .28 | .11 |
| $I_4$ MOD | 44.66 | 34.17 | .66 | .63 | .42 | 1.68 | .54 | .36 | .27 | .10 |
| $I_5$ MOD | 51.06 | 36.96 | 1.07 | .68 | .35 | 4.29 | .24 | .25 | .26 | .12 |

[1]Balance iron
[2]Alloy also contains 1.18% aluminum

Mechanical properties of test bars from each of these above heats were measured at room temperature. The results of these tests are set forth in Table II.

TABLE III

| ROOM TEMPERATURE MECHANICAL PROPERTIES | | | | |
|---|---|---|---|---|
| ALLOY DESIGNATION | TENSILE STRENGTH P.S.I. | YIELD STRENGTH P.S.I | % ELONGATION | BRINELL HARDNESS NUMBER |
| Si19Cu | 54,900 | 34,100 | 12.5 | 157 |
| Si21Cu | 84,800 | 48,200 | 17.5 | 179 |
| Si25Cu | 79,400 | 38,700 | 18.5 | 179 |
| SiA123Cu | 70,800 | 39,800 | 13.5 | 170 |
| Si31Cu | 80,400 | 43,400 | 15.5 | 175 |
| HH30Cu | 80,600 | 42,400 | 26.0 | 160 |
| HH32Cu | 80,100 | 42,800 | 21.0 | 163 |
| HH38Cu | 64,800 | 39,700 | 15.5 | 163 |
| HH41Cu | 66,700 | 39,000 | 12.0 | 165 |
| HK31Cu | 80,000 | 36,000 | 21.0 | 160 |
| HK33Cu | 66,700 | 39,000 | 18.0 | 165 |
| HK36Cu | 63,000 | 38,200 | 15.5 | 170 |
| HK46Cu | 63,400 | 37,300 | 10.0 | 163 |
| HK51Cu | 67,800 | 47,900 | 9.0 | 174 |
| HN30Cu | 64,900 | 36,100 | 13.0 | 148 |
| HP25Cu | 80,300 | 42,700 | 24.0 | 166 |
| HP39Cu | 73,600 | 31,700 | 15.0 | 172 |
| HP42Cu | 59,000 | 36,000 | 13.5 | 175 |
| HP46Cu | 68,100 | 48,500 | 11.5 | 170 |
| HT34Cu | 62,100 | 47,800 | 12.5 | 156 |
| $I_1$ | 56,900 | 38,300 | 6.0 | 182 |
| $I_2$ | 66.300 | 56,300 | 2.5 | 217 |
| $I_3$ | 64,400 | 41,100 | 3.5 | 206 |
| $I_4$ | 67,100 | 50,500 | 3.0 | 197 |
| $I_5$ | 65,200 | 45,000 | 4.0 | 179 |
| $I_6$ | 71,000 | 47,200 | 12.0 | 146 |
| $I_1$ MOD. | 59,000 | 37,600 | 11.5 | 184 |
| $I_2$ MOD. | 67,200 | 55,400 | 3.5 | 204 |
| $I_4$ MOD. | 60.100 | 39,000 | 6.0 | 196 |
| $I_5$ MOD. | 66,300 | 46,100 | 4.0 | 184 |

Alloy $I_3$ contains copper and differs from alloys $I_1$, $I_1$ MOD, HP39Cu and HP42CU by having higher carbon and chromium contents and lower cold elongation.

Of the alloys exemplified in the '934 patent, alloy $I_1$ may be compared to alloys $I_1$ Mod., HP39Cu and HP42Cu, all of which have almost the same carbon content. Alloy $I_1$ contains 2.65% combined content of the carbide forming elements molybdenum and columbium, no copper, and has the lowest elongation of these four alloys. The three alloys $I_1$ Mod., HP39Cu and HP42Cu, all contain less than 1.5% combined content of the carbide forming elements molybdenum, tungsten, columbium and titanium, and the two HP-type alloys also contain copper. Smaller amounts each of the four carbide formers gave higher cold elongations than larger amounts of two and the two copper containing alloys, HP39Cu and HP42Cu, have the highest elongation of these four alloys. As is shown below, the rupture life of $I_1$ at any stress level and temperature is the lowest of this group.

The very low elongation values of alloys $I_2$ and $I_4$ are probably a result of their high carbon, nickel and chromium contents. An even lower content of carbon and of the carbide formers molybdenum and tungsten would not be expected to offset the elongation-reducing tendencies of such high nickel and chromium contents. It is evident that alloy $I_5$ MOD., which contains small amounts of each of the elements, molybdenum, tungsten, columbium and titanium, along with a higher amount of carbon, has somewhat greater rupture life than alloy $I_5$, but no increase in cold elongation.

Alloy $I_6$ is the only exemplary alloy of the '934 patent to have a high elongation coupled with very low rupture life, both effects being due to almost no carbon content. Except for alloy $I_6$ none of the exemplary alloys of the '934 patent have acceptable room temperature elongation.

EXAMPLE 2

Bars from all of the heats of Example 1 were tested on standard creep/rupture frames at various stresses at 1600° F., 1700° F., 1800° F. and 2000° F. Since the carbon content of any heat resistant alloy is a major determinant of hot strength, stress levels of the various alloys were selected according to carbon levels to provide rupture lives of from a few thousand hours to less than one hundred hours. The results of these tests are set forth in Tables III, IV, V and VI. Test results were rounded to the nearest hour.

The modifications of alloys $I_1$, $I_2$, $I_4$ and $I_5$ all clearly demonstrate that microalloying with the microalloying group of elements, molybdenum, tungsten, columbium and titanium, as specified in the present invention, resulted in very substantial increases in rupture lives as compared to the alloys from which they were derived. No modification of alloy $I_6$ was attempted because significant improvements in hot strength aren't possible when virtually no carbon is present in the alloy.

TABLE IV

| ALLOY DESIGNATION | RUPTURE LIVES AT 1600° F. STRESS LEVEL, P.S.I. 4000 | 5000 | 6000 | 7000 | 8000 | 9000 |
|---|---|---|---|---|---|---|
| Si19Cu | 1251 | 252 | — | — | — | — |
| Si21Cu | 1462 | 321 | — | — | — | — |
| Si25Cu | 1662 | 1098 | — | — | — | — |
| SiA123Cu | 1521 | 714 | — | — | — | — |
| Si31Cu | 1749 | 993 | — | — | — | — |

TABLE IV-continued

| ALLOY DESIGNATION | RUPTURE LIVES AT 1600° F. STRESS LEVEL, P.S.I. 4000 | 5000 | 6000 | 7000 | 8000 | 9000 |
|---|---|---|---|---|---|---|
| HH30Cu | 1688 | 957 | — | — | — | — |
| HH32Cu | 2004 | 1116 | — | — | — | — |
| HH38Cu | — | 1748 | 179 | — | — | — |
| HH41Cu | — | 1801 | 187 | — | — | — |
| HK31Cu | — | 960 | 161 | — | — | — |
| HK33Cu | — | 1679 | 281 | — | — | — |
| HK36Cu | — | 2348 | 549 | — | — | — |
| HK46Cu | — | — | 1750 | 292 | — | — |
| HK51Cu | — | — | 1793 | 308 | — | — |
| HN30Cu | — | — | 1679 | 393 | — | — |
| HP25Cu | 1879 | 768 | — | — | — | — |
| HP39Cu | — | — | 2315 | 851 | — | — |
| HP42Cu | — | — | 2936 | 1186 | — | — |
| HP46Cu | — | — | — | 1343 | 251 | — |
| HT34Cu | — | — | 855 | 251 | — | — |
| $I_1$ | — | — | — | — | 224 | 91 |
| $I_2$ | — | — | — | — | 643 | 212 |
| $I_3$ | — | — | — | — | 267 | 78 |
| $I_4$ | — | — | — | — | 515 | 163 |
| $I_5$ | — | 640 | 158 | — | — | — |
| $I_6$ | 298 | 63 | — | — | — | — |
| $I_1$ MOD. | — | — | — | — | 687 | 281 |
| $I_2$ MOD. | — | — | — | — | 1679 | 817 |
| $I_4$ MOD. | — | — | — | — | 1073 | 491 |
| $I_5$ MOD. | — | 827 | 189 | — | — | — |

TABLE V

| ALLOY DESIGNATION | RUPTURE LIVES AT 1700° F. STRESS LEVEL, P.S.I. 3000 | 3500 | 4000 | 5000 | 6000 |
|---|---|---|---|---|---|
| Si19Cu | 1260 | 395 | — | — | — |
| Si21Cu | 1177 | 296 | — | — | — |
| Si25Cu | 1502 | 531 | — | — | — |
| SiA123Cu | 1288 | 409 | — | — | — |
| Si31Cu | 2628 | 793 | — | — | — |
| HH30Cu | 2421 | 1293 | 403 | — | — |
| HH32Cu | — | 1488 | 497 | — | — |
| HH38Cu | — | 1504 | 581 | — | — |
| HH41Cu | — | 1515 | 647 | — | — |
| HK31Cu | — | 1287 | 398 | — | — |
| HK33Cu | — | 1772 | 549 | — | — |
| HK36Cu | — | — | 1097 | 261 | — |
| HK46Cu | — | — | — | 1238 | 132 |
| HK51Cu | — | — | — | 1356 | 202 |
| HN30Cu | — | — | — | 840 | — |
| HP25Cu | — | 1287 | 398 | — | — |
| HP39Cu | — | — | — | 2301 | — |
| HP42Cu | — | — | — | 2313 | 511 |
| HP46Cu | — | — | — | 2715 | 610 |
| HT34Cu | — | — | 1319 | 367 | — |
| $I_1$ | — | — | — | 383 | — |
| $I_2$ | — | — | — | 808 | 163 |
| $I_3$ | — | — | — | 1021 | 334 |
| $I_4$ | — | — | — | 788 | 139 |
| $I_5$ | — | 380 | 155 | — | — |
| $I_6$ | 167 | 79 | — | — | — |
| $I_1$ MOD. | — | — | — | 1040 | 340 |
| $I_2$ MOD. | — | — | — | 2440 | 755 |
| $I_4$ MOD. | — | — | — | 1431 | 443 |
| $I_5$ MOD. | — | 1127 | 315 | — | — |

TABLE VI

| ALLOY DESIGNATION | RUPTURE LIVES AT 1800° F. STRESS LEVEL, P.S.I. 2000 | 2500 | 3000 | 4000 | 5000 |
|---|---|---|---|---|---|
| Si19Cu | 762 | 221 | — | — | — |
| Si21Cu | 1788 | 593 | — | — | — |
| Si25Cu | 2896 | 808 | — | — | — |
| SiA123Cu | 1854 | 721 | — | — | — |
| Si31Cu | 2826 | 721 | — | — | — |

TABLE VI-continued

| ALLOY DESIGNATION | RUPTURE LIVES AT 1800° F. STRESS LEVEL, P.S.I. 2000 | 2500 | 3000 | 4000 | 5000 |
|---|---|---|---|---|---|
| HH30Cu | — | 923 | — | — | — |
| HH32Cu | — | 1101 | 388 | — | — |
| HH38Cu | — | 1216 | 401 | — | — |
| HH41Cu | — | 1296 | 371 | — | — |
| HK31Cu | 3430 | 1010 | — | — | — |
| HK33Cu | — | 1681 | 495 | — | — |
| HK36Cu | — | 2527 | 912 | — | — |
| HK46Cu | — | — | 2040 | 443 | — |
| HK51Cu | — | — | 2092 | — | — |
| HN30Cu | — | — | — | 744 | 107 |
| HP25Cu | — | 1238 | — | — | — |
| HP39Cu | — | — | 2526 | 389 | — |
| HP42Cu | — | — | — | 416 | — |
| HP46Cu | — | — | — | 1518 | 243 |
| HT34Cu | — | — | 783 | 208 | — |
| $I_1$ | — | — | 823 | 143 | — |
| $I_2$ | — | — | 1861 | 268 | — |
| $I_3$ | — | — | 2827 | 501 | — |
| $I_4$ | — | — | 1723 | 186 | — |
| $I_5$ | — | 342 | 120 | — | — |
| $I_6$ | 133 | — | — | — | — |
| $I_1$ MOD. | — | — | 2061 | 365 | — |
| $I_2$ MOD. | — | — | — | 824 | 225 |
| $I_4$ MOD. | — | — | 1010 | 447 | — |
| $I_5$ MOD. | — | 455 | 211 | — | — |

TABLE VI

| ALLOY DESIGNATION | RUPTURE LIVES AT 2000° F. STRESS LEVEL, P.S.I. 1000 | 1500 | 2000 |
|---|---|---|---|
| Si19Cu | 181 | — | — |
| Si21Cu | 208 | — | — |
| Si25Cu | 426 | — | — |
| SiA123Cu | 488 | — | — |
| Si31Cu | 566 | — | — |
| HH30Cu | 593 | — | — |
| HH32Cu | 602 | — | — |
| HH38Cu | 1024 | — | — |
| HH41Cu | 1061 | — | — |
| HK31Cu | 571 | — | — |
| HK46Cu | — | 473 | — |
| HK51Cu | 1266 | 478 | — |
| HN30Cu | — | 1271 | 498 |
| HP25Cu | 1395 | 376 | — |
| HP39Cu | — | 1796 | 388 |
| HP42Cu | — | 1827 | 473 |
| HP46Cu | — | 2056 | — |
| HT34Cu | — | 549 | 163 |
| $I_1$ | — | 214 | — |
| $I_2$ | — | 385 | — |
| $I_3$ | — | 844 | — |
| $I_4$ | — | 296 | — |
| $I_5$ | 62 | — | — |
| $I_6$ | 55 | — | — |
| $I_1$ MOD. | — | 601 | — |
| $I_2$ MOD. | — | 1157 | — |
| $I_4$ MOD. | — | 653 | — |
| $I_5$ MOD. | 88 | — | — |

All exemplary alloys of the '934 patent suffered from very poor hot strength or low room temperature elongation or both. Even attempts to improve those properties by modification were largely ineffective. For example, alloy $I_3$ is a modified HP-type base alloy and may be compared to the lower carbon HP46Cu. While these two alloys are about equal at 1600° F., alloy $I_3$ is obviously quite inferior at all higher temperatures. Also, alloys $I_5$ and $I_5$ MOD. contain over 4% copper and suffered from low elongations, though hot strengths were raised somewhat in alloy $I_5$ MOD. by increasing carbon content.

As noted above, the '934 patent states that the judicious choice of a Ni/Cr ratio between 1.20 and 1.40 is the main factor in the striking improvement of the alloys of the invention. The SFSA-ACE alloys have the following Ni/Cr ratios: HF, 0.50; HH, 0.48; HI, 0.57; HK, 0.77; HL, 0.67; HN, 1.19; HP, 1.35; HT, 2.06; HU, 2.05; HW, 54.00; and HX, 3.91. Since these alloys are expected to have good hot strengths and long service lives, it is quite obvious that a Ni/Cr ratio between 1.20 and 1.40 is not a significant factor in achieving that end. The Ni/Cr ratio may very well be important for maximum carburization resistance, but obviously does not relate to high hot strength, weldability or room temperature elongation.

Because only seven creep rupture test bars were available from each heat, comparisons are clearer when the test results are correlated by the well-know Larsen-Miller parameter. Such correlations are set forth in Table VII on the basis of implied stress levels for alloys of the invention that would be expected to give 10,000-hour rupture lives. Also included in Table VIII are the commonly published values for several standard SFSA-ACI alloys at different carbon levels.

TABLE VIII

| ALLOY DESIGNATION | 10,000-HOUR RUPTURE STRESS P.S.I. 1600° F. | 1800° F. | 2000° F. |
|---|---|---|---|
| Si20Cu | 2500 | 900 | 500 |
| Si25Cu | 3100 | 1100 | 600 |
| Si30Cu | 3700 | 1400 | 630 |
| HH30Cu | 3700 | 1450 | 500 |
| HH35Cu | 3900 | 1600 | 550 |
| HH40Cu | 4300 | 2200 | 600 |
| HK30Cu | 3700 | 1500 | 450 |
| HK35Cu | 4200 | 1700 | 470 |
| HK40Cu | 4700 | 1900 | 550 |
| HK45Cu | 5200 | 2300 | 580 |
| HP35Cu | 4800 | 2400 | 800 |
| HP40Cu | 5400 | 2900 | 900 |
| HP45Cu | 6000 | 3300 | 1000 |
| Standard alloys | | | |
| HH30 | 2000 | 800 | 280 |
| HH35 | 2200 | 850 | 300 |
| HH40 | 2300 | 900 | 330 |
| HH50 | 3200 | 1350 | 380 |
| HK30 | 3300 | 1400 | 400 |
| HK40 | 3800 | 1700 | 500 |
| HK50 | 4400 | 2000 | 580 |
| HP45 | 5100 | 2200 | 600 |
| HP55 | 5600 | 2600 | 700 |

From the foregoing, it is evident that alloys prepared according to the present invention typically have hot strengths approximately equal to the hot strengths of the same alloy base types but of about 0.1% higher carbon content. Thus, at any given level of hot strength at any temperature the alloys of the invention will always be of lower carbon content and of higher tensile ductility and weldability than standard alloys. In the case of the high silicon alloys there are no standard alloys, but the microalloyed high silicon alloys of the invention possess excellent ductilities and hot strengths as compared to alloys of similar carbon levels.

Although specific examples of the present invention are provided herein, it is not intended that they are exhaustive or limiting of the invention. These illustrations and explanations are intended to acquaint others skilled in the art with the invention, its principles, and is practical application, so that they may adapt and apply the invention in its numerous forms, as may be best suited to the requirements of a particular use.

What is claimed is:

1. An alloy consisting of a base alloy, about 0.6% to about 2.5% copper and about 0.55% to about 2.65% of a microalloying group of elements, said base alloy being selected from the group consisting of H-type alloys and high silicon alloys, said alloys having the following compositions by weight:

| | Base Alloy | |
|---|---|---|
| | H-Type | High Silicon |
| Nickel | 8% to 62% | 10.5 to 28% |
| Chromium | 12% to 32% | 14.8 to 23% |
| Silicon | up to 2.5% | 3% to 6.6% |
| Manganese | up to 3% | 0.2% to 4% |
| Aluminum | less than 0.5% | up to 4% |
| Carbon | 0.12 to 0.6% | 0.12% to 0.5% |
| Cobalt | up to 1.5% | up to 1.5% |
| Iron | Essentially balance | Essentially balance |

and said microalloying group of elements consisting essentially of, by weight:

| | |
|---|---|
| Tungsten | 0.2% to 0.85% |
| Molybdenum | 0.2% to 0.85% |
| Columbium | 0.1% to 0.5% |
| Titanium | 0.05 to 0.45% |

2. An alloy of claim 1 where the microalloying group content is from about 1% to about 1.5% by weight.

3. An alloy of claim 1 where the copper content is from about 0.65% to about 2.0% by weight.

4. An alloy of claim 1 where the base alloy is an H-type alloy.

5. An alloy of claim 1 where the base alloy is a high silicon alloy.

6. An alloy of claim 4 where the copper content is about 0.75% to about 1.8% by weight, and the base alloy composition is, by weight:

| | |
|---|---|
| Nickel | about 12% to about 38% |
| Chromium | about 15% to about 26% |
| Silicon | up to about 1% |
| Manganese | up to about 2.5% |
| Aluminum | less than 0.5% |
| Carbon | about 0.25% to about 0.5% |
| Cobalt | up to 1.5% |
| Iron | Essentially balance |

7. An alloy of claim 6 where the microalloying group content is from about 1% to about 1.5% by weight.

8. An alloy of claim 5 where the copper content is about 0.65% to about 1.1% and the base alloy composition is, by weight:

| | |
|---|---|
| Nickel | 11% to 22% |
| Chromium | 15% to 21% |
| Silicon | 3.5% to 6.3% |
| Manganese | up to 2.5% |
| Aluminum | up to about 1.2% |
| Carbon | 0.2% to 0.3% |
| Cobalt | up to 1.5% |
| Iron | Essentially balance |

9. An alloy of claim 8 where the microalloying group content is from about 1% to about 1.5%, by weight.

10. An alloy of claim 4 where the copper content is in the range of about 0.8%, the content of the microalloying group is in the range of about 1% to about 1.2%, and the base alloy composition is, by weight:

| | |
|---|---|
| Nickel | about 13% to about 15% |
| Chromium | about 24% to about 25% |
| Silicon | about 0.5% to about 0.8% |
| Manganese | about 0.8% to about 1.2% |
| Aluminum | less than 0.5% |
| Carbon | about 0.3% |
| Cobalt | up to 1.5% |
| Iron | Essentially balance |

* * * * *